United States Patent [19]

Tsuchida et al.

[11] 4,166,532

[45] Sep. 4, 1979

[54] PACKAGE FOR BATTERIES

[75] Inventors: Takashi Tsuchida, Kosai; Kenichi Shinoda, Toyohashi; Kohei Yamamoto, Kosai; Fumio Ikuma, Hamamatsu; Yuzo Tanaka, Kosai, all of Japan

[73] Assignee: Fuji Electrochemical Co., Ltd., Tokyo, Japan

[21] Appl. No.: 898,853

[22] Filed: Apr. 21, 1978

Related U.S. Application Data

[63] Continuation of Ser. No. 780,184, Mar. 22, 1977, abandoned.

[51] Int. Cl.[2] ..... B65D 65/02

[52] U.S. Cl. ..... 206/333; 206/497; 206/806; 206/634

[58] Field of Search ..... 206/432, 333, 143, 806, 206/497, 620, 634

[56] References Cited

U.S. PATENT DOCUMENTS

| | | | |
|---|---|---|---|
| 2,711,346 | 6/1955 | Irwin et al. | 206/497 |
| 2,888,164 | 5/1959 | Corwin | 206/432 |
| 3,046,711 | 7/1962 | Harrison | 206/497 |
| 3,756,397 | 9/1973 | Ganz | 206/432 |
| 3,863,837 | 2/1975 | Spiegel et al. | 206/497 |
| 3,881,601 | 5/1975 | Walus et al. | 206/333 |
| 3,990,578 | 11/1976 | Roeser | 206/333 |

FOREIGN PATENT DOCUMENTS

| | | | |
|---|---|---|---|
| 2345499 | 4/1974 | Fed. Rep. of Germany | 206/497 |
| 1542575 | 9/1968 | France | 206/333 |
| 1380238 | 4/1973 | United Kingdom | 206/143 |

*Primary Examiner*—Joseph Man-Fu Moy
*Attorney, Agent, or Firm*—Wenderoth, Lind & Ponack

[57] ABSTRACT

A package for batteries which comprises a header board and a heat-shrunk thermoplastic film holding the batteries relative to the header board. The header board has a vertical wall and a skirt integrally extending downwardly from the lower end of the vertical wall and covering a portion of the battery. The thermoplastic film covers the skirt and the batteries.

5 Claims, 5 Drawing Figures

PACKAGE FOR BATTERIES

This is a continuation, of application Ser. No. 780,184, filed Mar. 22, 1977 now abandoned.

BACKGROUND OF THE INVENTION

This invention relates to an improved package for enclosing batteries by a heat-shrinkable thermoplastic film.

A package of this type is known in U.S. Pat. No. 3,424,306, in which a strip of thin heat shrinkable thermoplastic film is folded upon itself in approximate edge to edge relationship to enclose batteries therein, and a header board is sealed to the edges of the film. In such a known package, however, the upper ends of the batteries are not normally covered by the film and, therefore, a narrow clearance is formed between the film and the upper ends of the batteries, which ends usually constitute the positive terminal ends. Accordingly, this clearance allows water and other foreign materials to enter therethrough and remain on the terminal surfaces of the batteries, with the result that the terminal surfaces of the batteries will be rusted when the batteries are stored on shelves for a relatively long period of time.

Further, in the known package set forth above, the header board of the package is provided along the back of the batteries in a direction tangential of the juxtaposed batteries. Accordingly, when the package is hung for display in a store on a nail or pin loosely passing through a hole made through the header board, the package inclines downwardly with the front battery surfaces facing to the floor of the store. Such inclined arrangement of the packages is not desirable for display for sale because the trademark or design on the front surfaces of the batteries faces downwards.

SUMMARY OF THE INVENTION

Accordingly, an object of the present invention is to provide a package for batteries which can cover the top terminal end surfaces of the batteries without allowing any water and other foreign materials to enter into a space around the top terminal end surfaces thereof.

Another object of the present invention is to provide a package for batteries which allows the batteries therein to be hung uprightly on a nail or pin loosely passing through a hole in a header board thereof.

Still another object of the present invention is to provide a package for batteries, which package can provide wider spaces for advertisement of the batteries.

Another object of the present invention is to provide a package for batteries which can firmly hold the batteries relative to a header board by a heat-shrunk thermoplastic film.

A further object of the present invention is to provide a package for batteries which is simple in structure, easy to form, and inexpensive in packing costs.

BRIEF DESCRIPTION OF THE DRAWINGS

The aforementioned and other objects and features of the present invention will become more apparent when taken in conjunction with the accompanying drawings, in which.

DETAILED DESCRIPTION OF THE INVENTION

Figure 1:
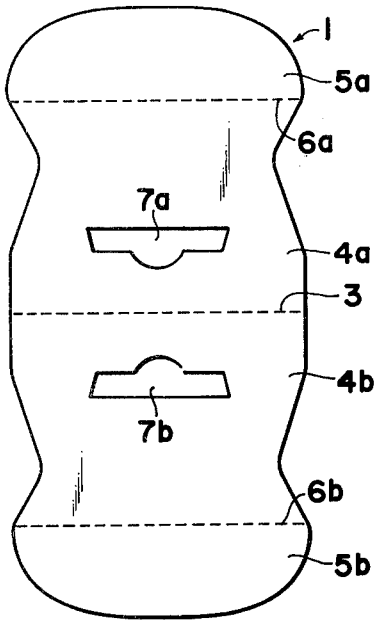
FIG. 1 is a developed view of a header board adapted to a package for batteries according to the present invention.
Figure 2:
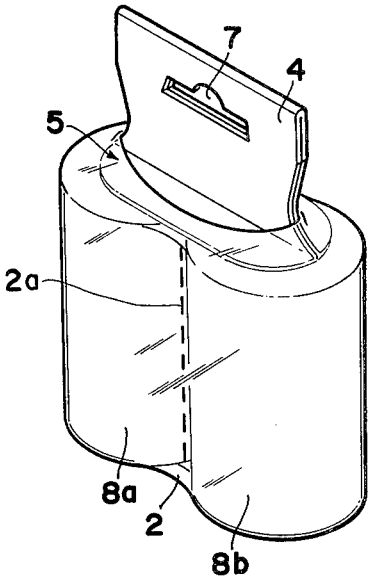
FIG. 2 is a perspective view of the package according to the present invention.
Figure 3:
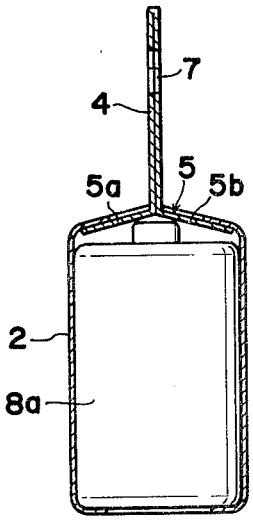
FIG. 3 is a side sectional view of the package according to the present invention.

Referring now to a first embodiment of the present invention shown in FIGS. 1 through 3, the present package for batteries comprises a header board 1 and a heat-shrunk thermoplastic film 2. As shown in the developed view of FIG. 1, the header board 1 is formed to be symmetrical along a folding center line 3 and divided into two sections 4*a* and 4*b* along the line 3, the first section 4*a* being shown in the upper part above the line 3 and the second section 4*b* being shown in the lower part below the line 3 in FIG. 1. The first and second sections 4*a* and 4*b* of the header board 1 also have folding lines 6*a* and 6*b*, respectively, at positions between the center line 3 and the opposite end lines of the header board 1. The upper and lower portions outwardly of the folding lines 6*a* and 6*b* on the header board 1 shown in FIG. 1 are skirt portions 5*a* and 5*b*, respectively. Each skirt portion has substantially a semi-elliptical shape. Both intermediate portions of the board 1 between the center line 3 and the intermediate folding lines 6*a* and 6*b* have laterally elongated holes 7*a* and 7*b*, respectively, which are adapted to be registered with each other to form a hanger hole when the header board 1 is folded along the center line 3.

The header board 1 of the configuration set forth above is folded along the line 3 so that the intermediate portion between the lines 3 and 6*a* of the first section 4*a* contacts the other intermediate portion between the lines 3 and 6*b* of the second section 4*b*, thereby forming a vertical wall 4. Further, the lines 6*a* and 6*b* are partially folded so that the skirt portions 5*a* and 5*b* form a skirt 5 as shown in FIGS. 2 and 3.

To enclose batteries 8*a* and 8*b* in accordance with the first embodiment of the present invention, two or more batteries 8*a* and 8*b* are juxtaposed side by side and set up with the positive terminal ends extending in the vertical upward direction. Then, the header board 1 folded and formed as set forth above is placed upon the upper end surfaces of the batteries 8*a* and 8*b* so that the skirt 5 covers the positive terminal ends of these batteries. Thereafter, a tubular-shaped heat-shrinkable thermoplastic film 2 is provided to enclose the cylindrical side surfaces of the batteries 8*a* and 8*b* and to extend for a predetermined length beyond the upper and lower end surfaces of the batteries. Thus, when a heat sufficient to shrink the film 2 is applied, the film 2 is shrunk and closely covers the side surfaces of the batteries 8*a* and 8*b*, the upper surface of the skirt 5, and the bottom circumferential portion of the batteries.

Figure 4:
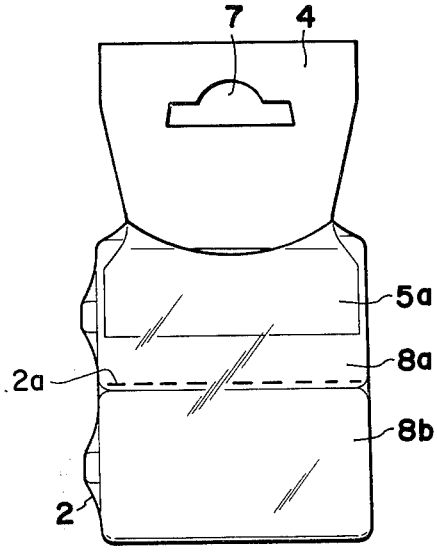
FIG. 4 is a front view of a package for batteries according to a second embodiment of the present invention.
Figure 5:
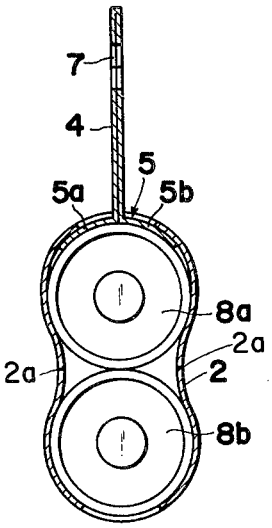
FIG. 5 is a side sectional view of the package according to the second embodiment of the present invention.

In a second embodiment shown in FIGS. 4 and 5, the header board 1 which is the same as that of the first embodiment is used. The only difference from the first embodiment is the arrangement of the batteries 8*a* and 8*b* to be packed. That is, the two batteries 8*a* and 8*b* are stacked one upon the other with the terminal positive ends extending in the horizontal direction, and the skirt 5 of the header board 1 is placed upon the cylindrical side surface section of the top battery 8*a*. Thus, after arranging the batteries and placing the header board thereon, a tubular heat-shrinkable thermoplastic film 2 is provided to cover the batteries 8*a* and 8*b* and the skirt 5 and shrunk is by application of heat as in the case of the first embodiment.

In any of the embodiments of the invention, it is preferable that the heat-shrinkable thermoplastic film 2 be made of transparent material so that the design or trademark on the batteries can be seen through the film. Also, it is preferable that the thermoplastic film 2 have a seies of small perforations 2*a* therethrough substantially in parallel to the contact line of the adjacent two batteries 8*a* and 8*b* in order that the film 2 can be torn easily along the perforations when it is desired to take out the batteries from the package.

In the package thus formed in accordance with the present invention, the header board has the skirt 5 to cover the terminal top end surfaces of the batteries and the skirt is further covered by the heat-shrunk thermoplastic film, so that any water and other foreign materials which would cause rusting of the terminals of the batteries are effectively prevented from contacting the terminal top end surfaces thereof.

The skirt 5 of the header board 1 is relatively wide and the thermoplastic film 2 is shrunk to a smaller diameter so as to cover the skirt of a larger diameter, so that the film holding the relatively heavy batteries 8*a* and 8*b* is firmly connected to the header board and suspension of the batteries from the header board by the film is reliable. Also, the wide area of the skirt 5 can provide a wide space for advertisement of the batteries therein.

The vertical wall 4 of the header board 1 extends upwardly from substantially the top center of the skirt 5, so that when the package is hung by a pin loosely extending through the hole 7 in the header board, the package is suspended in an upright position. Accordingly, the present package may be very advantageously exhibited for sale.

Also, the header board 1 is formed by symmetrically folding a sheet of board and tubular-shaped heat-shrinkable thermoplastic material is used as the film 2, so that the present package is simple in structure, easy to form and inexpensive in packing costs.

Although the present invention has been described with reference to preferred embodiments thereof, many modifications and alterations may be made within the spirit of the present invention. What is claimed is:

1. In a battery package of the type including a plurality of cylindrical batteries, each having opposite circular ends, each said battery having at a first circular end thereof a terminal projection, said batteries being juxtaposed such that all of said terminal projections extend in the same direction, the improvement wherein said package further comprises:

a header board formed of a single sheet of board, said board having opposite first and second end edges equally spaced from a center line, and first and second intermediate lines, each said intermediate line being spaced by an equal distance from said center line on opposite sides thereof, such that first and second symmetrical intermediate board portions are formed between said center line and said first and second intermediate lines, respectively, and first and second symmetrical skirt board portions are formed between said first end edge and said first intermediate line and between said second end edge and said second intermediate line, respectively;

said single sheet of board being folded along said cetner line such that said first and second intermediate board portions are in mutual abutting contact to form a wall, said single sheet of board being folded at said first and second intermediate lines such that said first and second skirt board portions extend outwardly from opposite sides of said wall to form a skirt, said skirt having an elliptical configuration when viewed from a direction along said wall and perpendicular to said center line;

said header board being positioned with said skirt covering said first circular ends and said terminal projections of all of said batteries, with said skirt board portions being inclined relative to said first circular ends of said batteries, said inclined skirt board portions defining therebetween a free space within which said terminal projections are completely enclosed; and a heat-shrunk thermoplastic film covering the outer exposed cylindrical surfaces of said batteries and said skirt, said film holding said header board to said batteries in a position such that said terminal projections are completely covered by said skirt.

2. The improvement claimed in claim 1, wherein said first and second intermediate board portions of said wall have aligned holes therein, through which a hanger pin is adapted to be loosely fitted.

3. The improvement claimed in claim 1, wherein said thermoplastic film is transparent.

4. The improvement claimed in claim 1, wherein said thermoplastic film has therethrough a series of small perforations extending substantially parallel to the line of contact between adjacent said batteries.

5. The improvement claimed in claim 1, wherein the portion of said heat-shrunk thermoplastic film opposite said header board covers second circular ends of said batteries.

* * * * *